United States Patent [19]

Treene

[11] Patent Number: 4,798,670

[45] Date of Patent: Jan. 17, 1989

[54] SKIMMER VACUUM FILTER APPARATUS

[75] Inventor: William E. Treene, Upper Montclair, N.J.

[73] Assignee: Hayward Industries, Inc., Elizabeth, N.J.

[21] Appl. No.: 105,878

[22] Filed: Oct. 7, 1987

[51] Int. Cl.[4] ..... E04H 3/20

[52] U.S. Cl. ..... 210/169; 210/416.2; 210/238

[58] Field of Search ..... 210/169, 416.2, 232, 210/238; 4/490, 507

[56] References Cited

U.S. PATENT DOCUMENTS

| | | | |
|---|---|---|---|
| 2,844,255 | 7/1958 | Cavenah et al. | 210/169 |
| 2,900,079 | 8/1959 | Pace | 210/169 |
| 2,979,206 | 4/1961 | Konopka et al. | 210/169 |
| 3,618,774 | 11/1971 | Delphia | 210/169 |
| 3,841,487 | 10/1974 | Viliette | 210/169 |
| 3,864,262 | 2/1975 | Lang et al. | 210/169 |
| 3,910,840 | 10/1975 | Adam | 210/169 |
| 4,022,690 | 5/1977 | Smith | 210/169 |
| 4,108,775 | 8/1978 | Wilkes et al. | 210/169 |
| 4,126,925 | 11/1978 | Jacuzzi | 210/169 |
| 4,263,139 | 4/1981 | Erlich | 210/169 |
| 4,325,150 | 4/1982 | Buddy | 210/169 |
| 4,348,281 | 9/1982 | Perry et al. | 210/169 |
| 4,426,286 | 1/1984 | Puckett et al. | 210/169 |
| 4,637,873 | 1/1987 | DeSousa et al. | 210/169 |

*Primary Examiner*—Richard V. Fisher
*Assistant Examiner*—Coreen Y. Lee
*Attorney, Agent, or Firm*—Ralph W. Selitto, Jr.

[57] ABSTRACT

A filter includes a housing which removably receives a filter cartridge adapted to remove fine and coarse debris from water flowing therethrough. The filter is removably mounted in a skimmer well of a swimming pool in place of a conventional strainer basket. The interchangeability of the filter and the strainer basket permits them to be used selectively such that the strainer basket can be used during a pool skimming operation and the filter can be used during a pool vacuuming operation.

15 Claims, 8 Drawing Sheets

SKIMMER VACUUM FILTER APPARATUS

FIELD OF THE INVENTION

The present invention relates to a filter for a swimming pool, and, more particularly, to such a filter which is especially adapted for mounting in a skimmer well in place of a conventional strainer basket.

BACKGROUND OF THE INVENTION

A conventional swimming pool installation usually employs a pump and filter located adjacent to the pool for circulating and filtering the pool water. Typically, a skimmer assembly is installed in the wall of the pool in order to skim off the upper surface of the pool water before the water is circulated to the pump and filter. More particularly, the skimmer assembly includes a strainer basket adapted to remove coarse debris which may be floating on top of the pool water. One drawback of such a skimmer assembly is its inability to remove fine debris from the pool water. This drawback is not terribly critical when the skimmer assembly is operating in a skimming mode because, in such a mode, only the top surface of the water is being treated. However, for skimmer assemblies adapted to function in a vacuuming mode as well as in a skimming mode (see, for instance, U.S. Pat. Nos. 2,844,255; 2,900,079; 2,979,206; 3,864,262; 4,126,925 and 4,348,281), the inability to filter out fine debris becomes a more significant problem due to the fact that the water which is vacuumed from the bottom of the pool contains fine debris as well as coarse debris.

SUMMARY OF THE INVENTION

The present invention relates to a filter for a skimmer well which usually receives a strainer basket. More particularly, the filter includes a housing having an inlet end which is substantially open and an outlet end which is substantially closed. A filter cartridge is removably positioned inside the housing for filtering fine and coarse debris from water flowing through the filter cartridge. The housing is removably mounted in the skimmer well such that the filter is interchangeable with the strainer basket. The interchangeability of the strainer basket and the filter permits them to be used selectively such that the strainer basket can be used during a pool skimming operation and the filter can be used during a pool vacuuming operation. Because the strainer basket is typically provided as part of a conventional skimmer assembly, the present invention permits such an assembly to be converted into a system for performing a pool vacuuming operation by retrofitting the assembly with the filter and a removable lid which is fitted with a vacuum hose for the purpose of supplying pool water to the filter.

The versatility of the filter is enhanced by its compatibility with various different types of skimmer wells. Thus, in accordance with one mounting technique, the filter is suspended within the skimmer well. Alternatively, in accordance with another mounting technique, the filter is seated in the skimmer well.

In one embodiment, the filter cartridge includes a pair of end caps, one of which is provided with an outlet opening sized and shaped so as to releaseably receive a tubular post extending into the filter housing from its outlet end. A porous core and an annular filter element, which surrounds the core, extend between the end caps.

BRIEF DESCRIPTION OF THE DRAWINGS

For a better understanding of the present invention, reference is made to the following description of an exemplary embodiment considered in conjunction with the accompanying drawings, in which.

DESCRIPTION OF THE EXEMPLARY EMBODIMENT

A filter 10 includes a housing 12 and a filter cartridge 14, which is removably received in the housing 12 such that the filter cartridge 14 can be removed from the housing 12 and replaced with another filter cartridge. Once removed, the filter cartridge 14 can be cleaned and reused or it can be disposed of. The construction and operation of the housing 12 and the filter cartridge 14 will be described in greater detail below.

Figure 1:
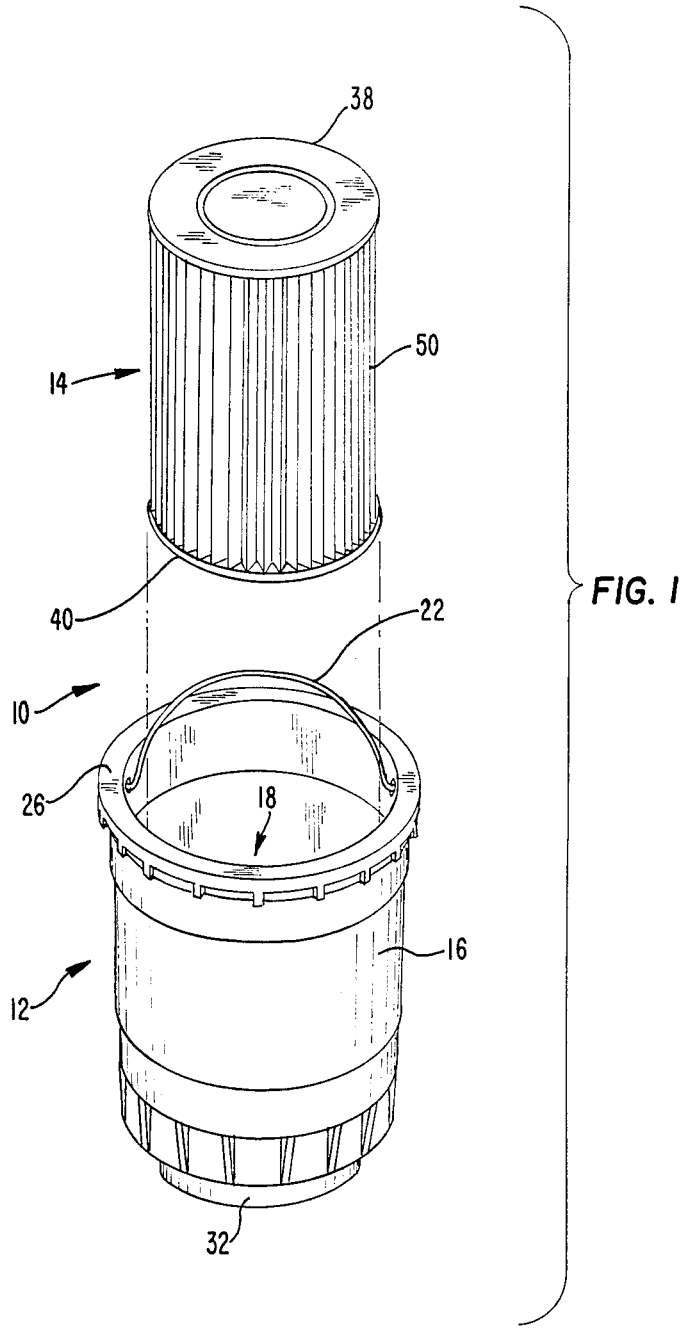
FIG. 1 is an exploded perspective view of a filter constructed in accordance with one exemplary embodiment of the present invention.
Figure 2:
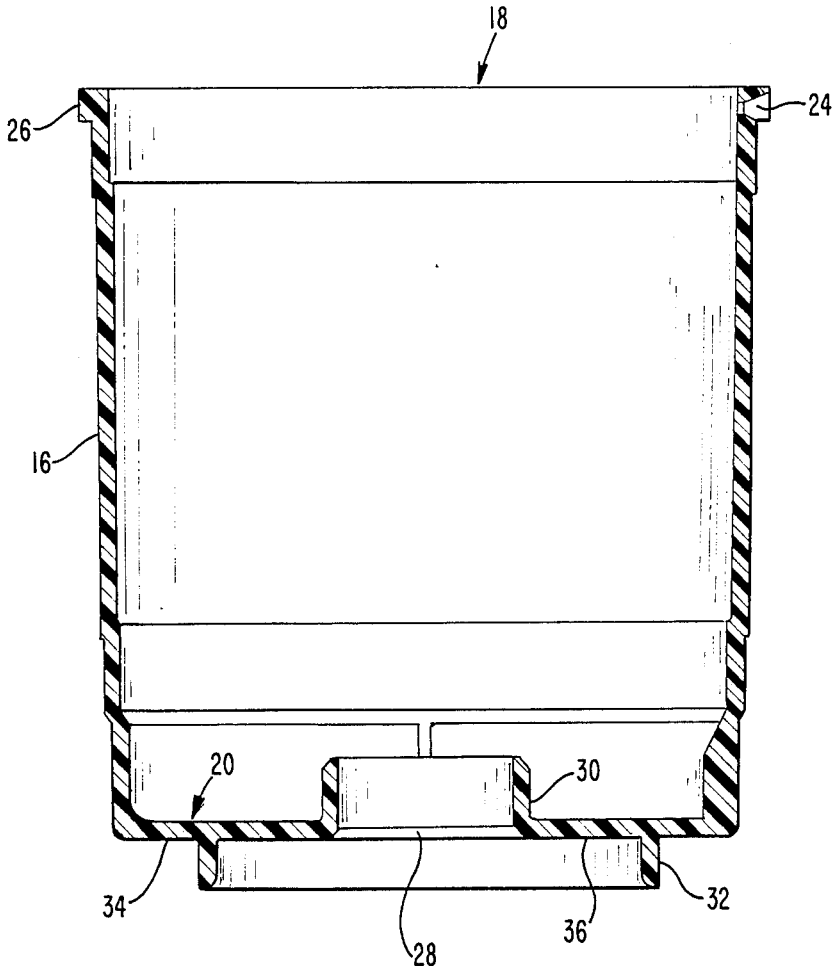
FIG. 2 is a cross-sectional view of a housing employed by the filter illustrated in FIG. 1, the cross section being taken through the central longitudinal axis of the housing.

Referring to FIGS. 1 and 2, the housing 12 has a generally cylindrical body 16 which is made from a suitable plastic material. The body 16 includes a substantially open upper end 18 and a substantially closed lower end 20 (see FIG. 2). A wire handle 22 is pivotally attached to the upper end 18 of the housing 12. More particularly, opposite ends of the handle 22 are removably received in holes 24 (only one being visible in FIG. 2), which pass through a circular rim 26 extending radially outwardly from the upper end 18 of the housing 12. The lower end 20 of the housing 12 includes an opening 28, which forms an outlet, and a boss 30, which extends around the opening 28 and into the body 16 of the housing 12. A circular flange 32 depends from the lower end 20 of the housing 12 and divides the lower end 20 into a radially outer portion 34 and a radially inner portion 36.

Figure 3:
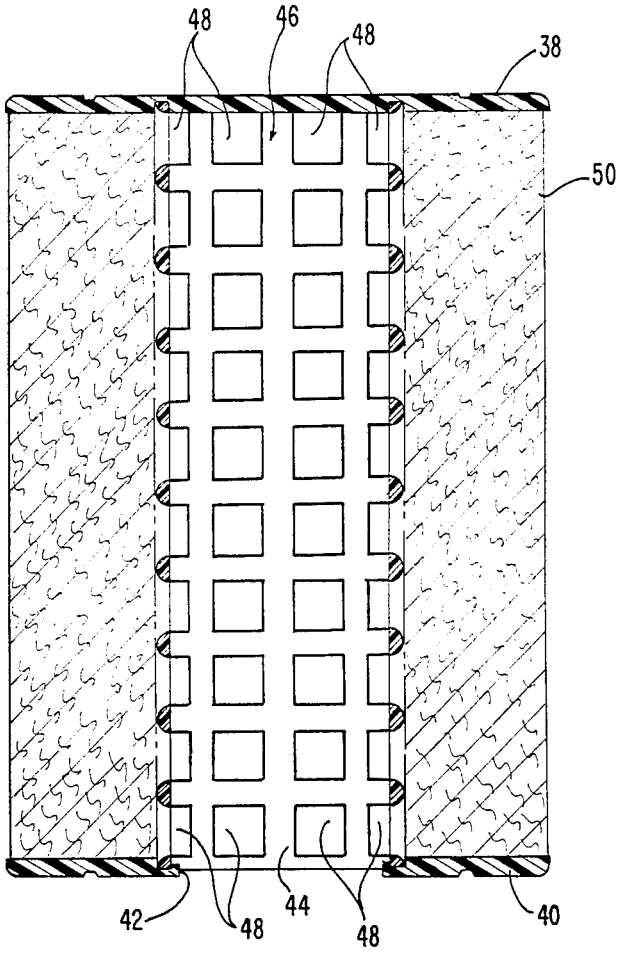
FIG. 3 is a cross-sectional view of a filter cartridge employed by the filter illustrated in FIG. 1, the cross section being taken through the central longitudinal axis of the filter cartridge.

With reference now to FIGS. 1 and 3, the filter cartridge 14 includes an upper end cap 38, which is made of plastic, and a lower end cap 40, which is also made of plastic and is provided with an opening 42. A cylindrical core 44, which is made of plastic, extends between the upper end cap 38 and the lower end cap 40. The core 44 includes a central passageway 46, which communicates with the opening 42 in the lower end cap 40, and perforations 48, which communicate with the passageway 46. The size and shape of the opening 42 and the core 44 are selected such that the boss 30 on the lower end 20 of the housing 12 can be inserted into the core 44 of the filter cartridge 14, whereby the boss 30 functions to properly locate the filter cartridge 14 in the housing 12. An annular filter element 50 surrounds the core 44 and extends between the upper end cap 38 and the lower end cap 40. The filter element 50 is pleated and is made from fabric selected for its ability to filter fine debris out of water flowing therethrough.

Figure 4:
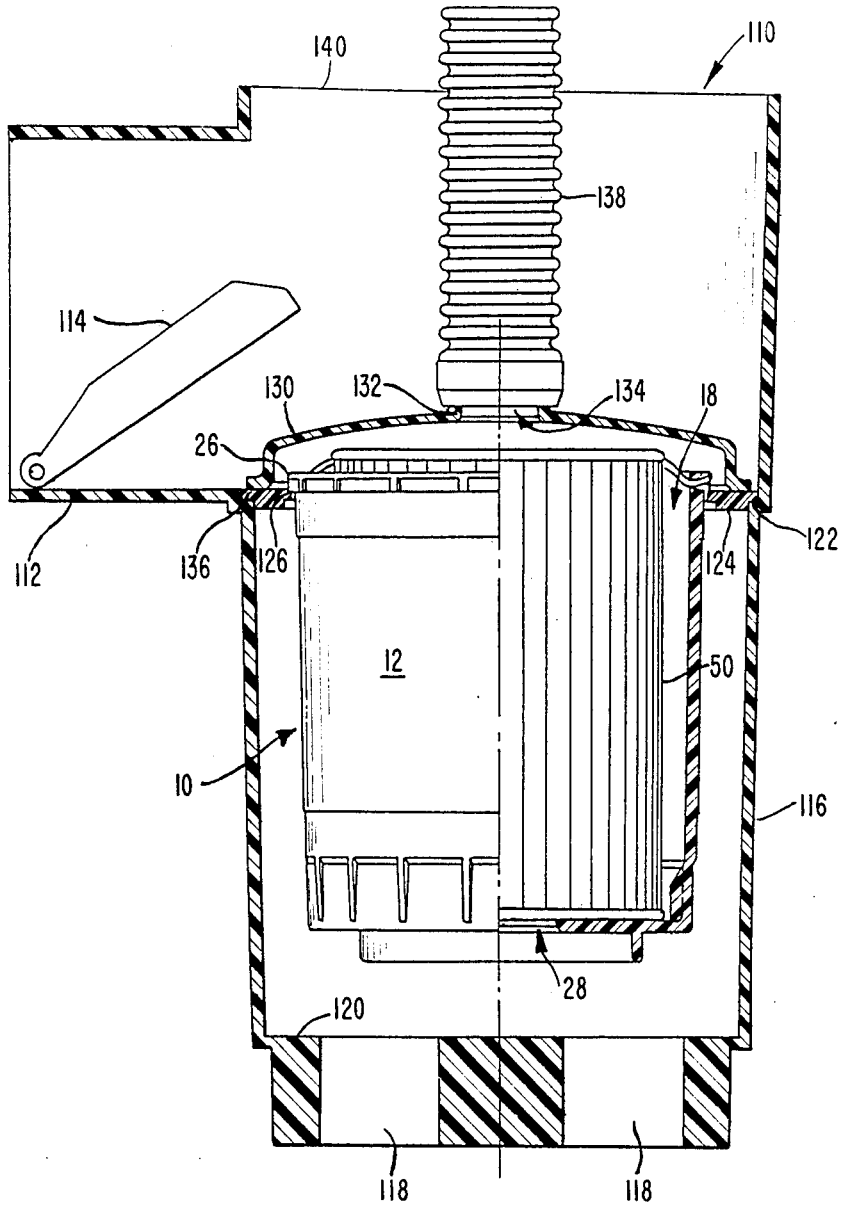
FIG. 4 is a partial cross-sectional view of one type of swimming pool skimmer assembly which is equipped with the filter illustrated in FIG. 1 and which is set up to perform a pool vacuuming operation.

Referring now to FIG. 4, the filter 10 is shown installed in a skimmer assembly 110 for a swimming pool. The skimmer assembly 110 includes a throat 112, which contains a weir 114, and a well 116, which normally receives a conventional strainer basket. Discharge ports 118 are provided in a floor 120 of the skimmer well 116. An upper end of the skimmer well 116 is provided with a circular ledge 122, which supports an annular support plate 124 such that the support plate 124 extends radially into the skimmer well 116. An inner circumferential edge 126 of the support plate 124 is notched so as to removably receive the rim 26 of the housing 12 in such a manner that the filter 10 is suspended in the skimmer well 116. A lid 130, having a fitting 132 with a passageway 134 therein, is removably mounted on an outer circumferential edge 136 of the support plate 124. The fitting 132 receives one end of a conventional vacuum hose 138, the other end of which is attached to a suction nozzle or tip (not shown) adapted to perform a vacuuming operation on the bottom of the swimming pool. Although the vacuum hose 138 is shown extending through an open upper end 140 of the skimmer assembly 110, the vacuum hose 138 could also be bent such that it extends through the throat 112 above the weir 114.

When performing a pool vacuuming operation, water from the floor of the pool is drawn into the vacuum hose 138 through the suction nozzle or tip (not shown). From the vacuum hose 138, the water flows through the passageway 134 of the lid 130 into the filter 10 through the open upper end 18 thereof. The water then flows through the filter element 50 and into the core 44 (see FIG. 3) through the perforations 48 (see FIG. 3) therein, the filter element 50 removing fine debris from the water. After flowing down through the passageway 46 (see FIG. 3) of the core 44, the filter water exits the filter 10 through the opening 28 in the housing 12. The water exiting from the filter 10 flows through the discharge ports 118 on its way to a conventional pool filter (not shown) located externally of the swimming pool. Thus, the pool water is subjected to multi-filtering as a result of its passage through the filter 10, which functions as a secondary filter or a prefilter, and the regular pool filter, which functions as a primary filter.

At the conclusion of a vacuuming operation, the lid 130 and the vacuum hose 138 can be removed from the skimmer well 116. After removing the filter 10 from the skimmer well 116, a conventional strainer basket (not shown) can be inserted into the skimmer well 116, whereby the skimmer assembly 110 can be used to perform a conventional skimming operation.

Other skimmer assemblies which can be equipped with or retrofitted with the filter 10 are illustrated in FIGS. 5–8. Various elements in FIGS. 5–8 which correspond to elements described above with respect to the skimmer assembly of FIG. 4 are designated by corresponding reference numerals increased by one hundred, two hundred, three hundred and four hundred, respectively. Unless otherwise stated, the skimmer assemblies of FIGS. 5–8 are constructed and operate in the same manner as the skimmer assembly of FIG. 4.

Figure 5:
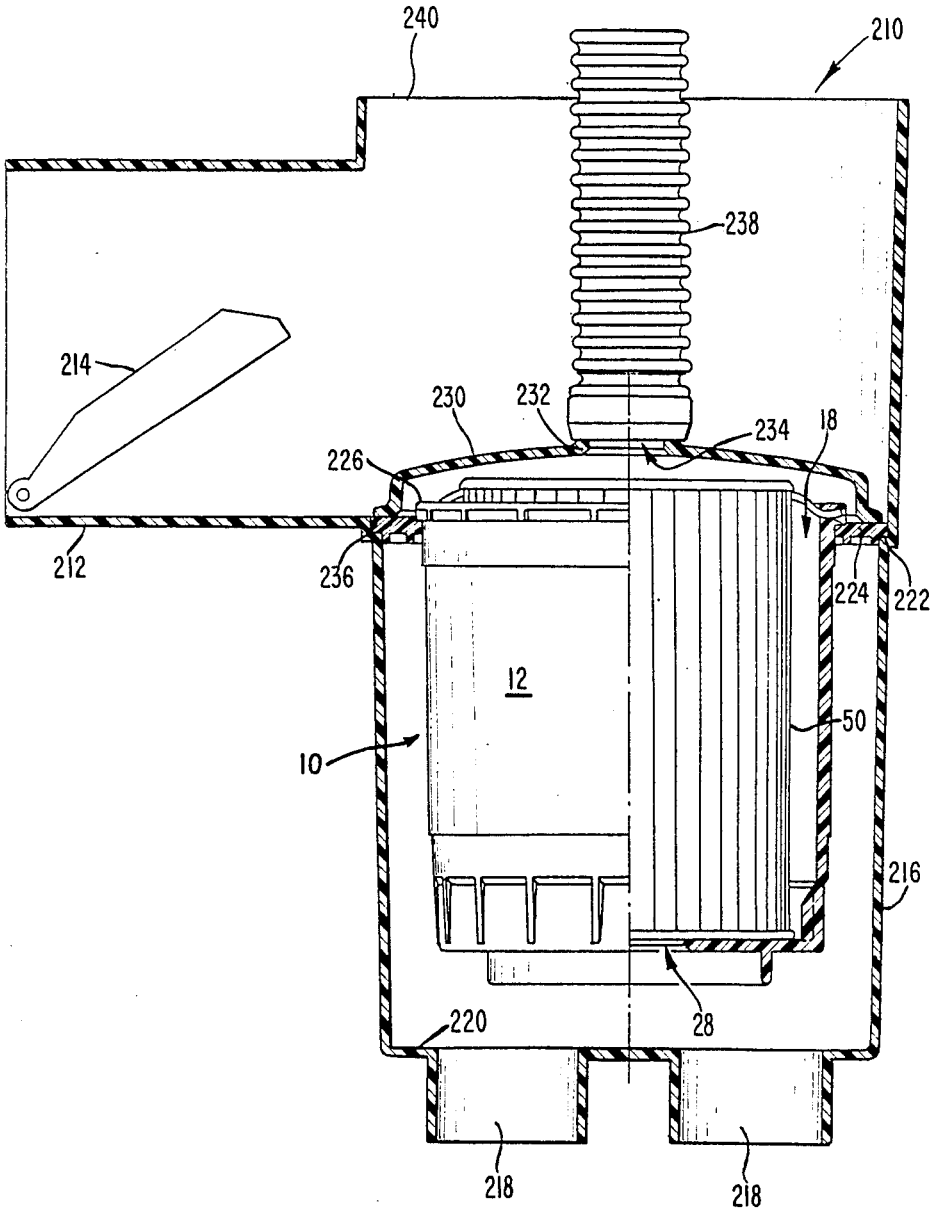
FIG. 5 is a partial cross-sectional view of another type of swimming pool skimmer assembly which is equipped with the filter illustrated in FIG. 1 and which is set up to perform a pool vacuuming operation.

With reference to FIG. 5, a skimmer assembly 210 is shown which is essentially identical to the skimmer assembly 110 illustrated in FIG. 4. The only differences relate to the design of an annular support plate 224 and discharge ports 218. Thus, the filter 10 is suspended in a skimmer well 216 and is commonly mounted with a lid 230 on the support plate 224.

Figure 6:
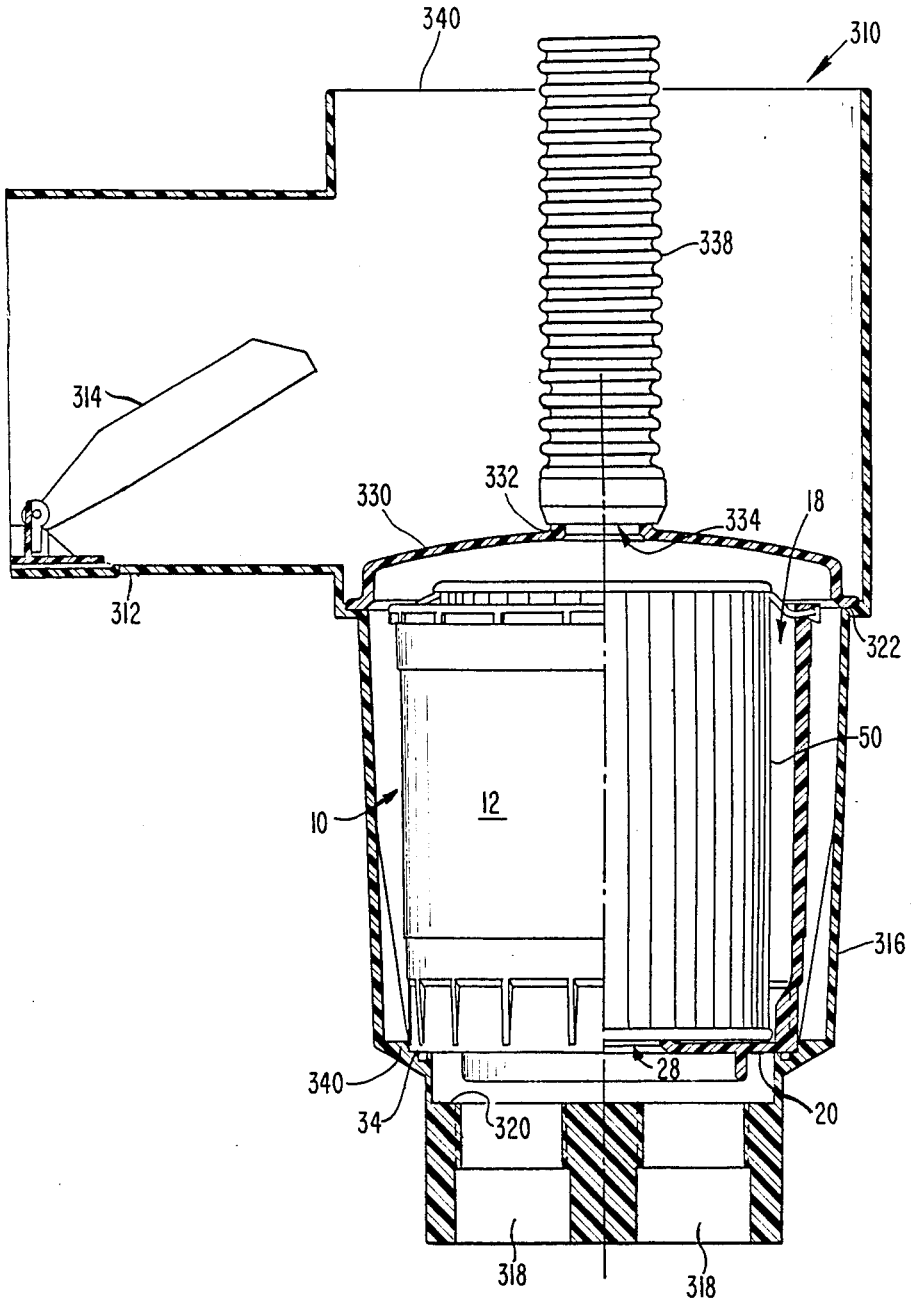
FIG. 6 is a partial cross-sectional view of a still further type of swimming pool skimmer assembly which is equipped with the filter illustrated in FIG. 1 and which is set up to perform a pool vacuuming operation.

Referring to FIG. 6, a skimmer assembly 310 is shown which eliminates the support plate 124 or the support late 224 of the skimmer assemblies 110, 210, respectively. More particularly, a lid 330 is mounted directly on a circular ledge 322 formed in an upper end of a skimmer well 316. Another circular ledge 340 is formed in a lower portion of the skimmer well 316, the ledge 340 being sized and shaped so as to receive the radially outer portion 34 of the lower end 20 of the housing 12, whereby the filter 10 is seated in the skimmer well 316. Thus, the lid 330 and the filter 10 are independently mounted in the skimmer well 316.

Figure 7:
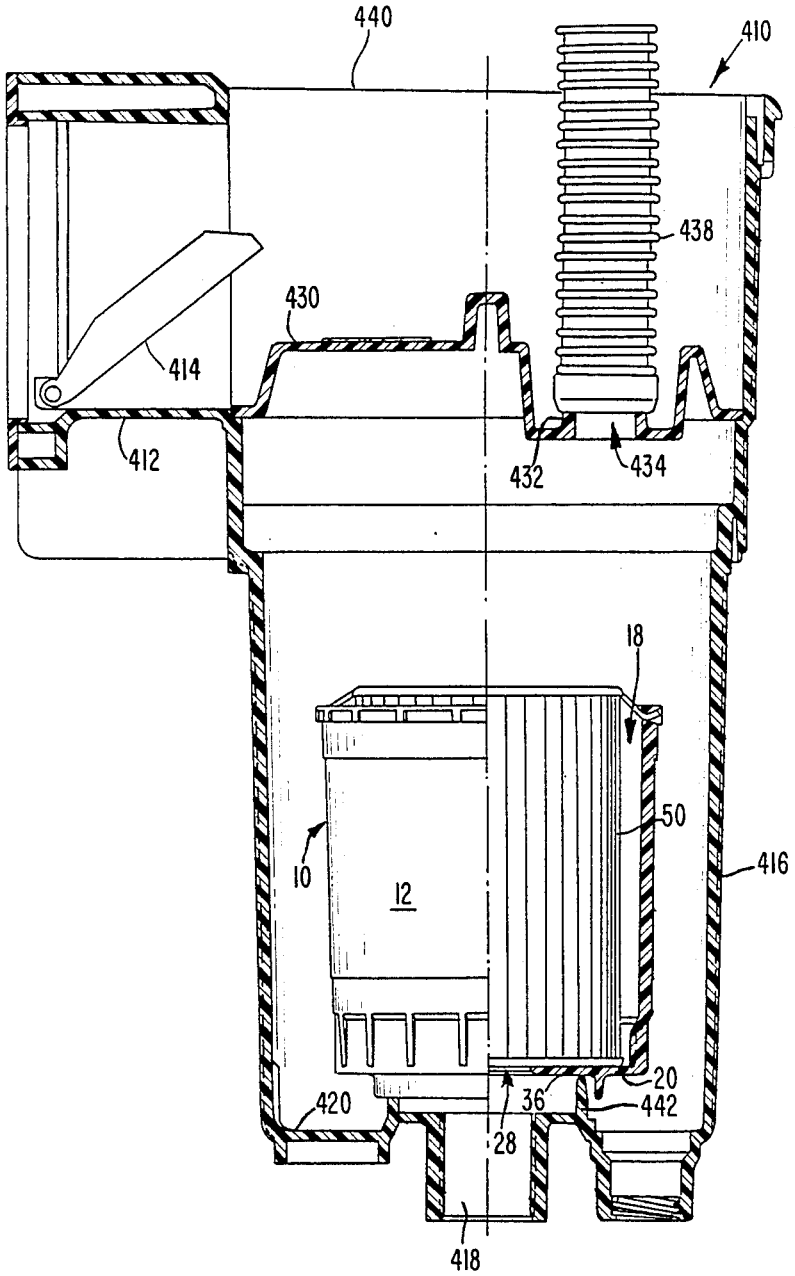
FIG. 7 is a partial cross-sectional view of yet another type of swimming pool skimmer assembly which is equipped with the filter illustrated in FIG. 1 and which is set up to perform a pool vacuuming operation.

With reference to FIG. 7, a skimmer assembly 410 is shown in which a lid 430 is mounted in a manner similar to the lid 330 of the skimmer assembly 310. Moreover, like the skimmer assembly 310, the skimmer assembly 410 has a skimmer well 416 in which the filter 10 is seated. However, in contrast to the skimmer assembly 310, the skimmer assembly 410 is provided with an annular mounting ring 442 on which the housing 12 of the filter 10 sits. More particularly, the mounting ring 442 extends upwardly from a floor 420 of the skimmer well 416 a distance sufficient so as to engage the radially inner portion 36 of the lower end 20 of the housing 12.

Figure 8:
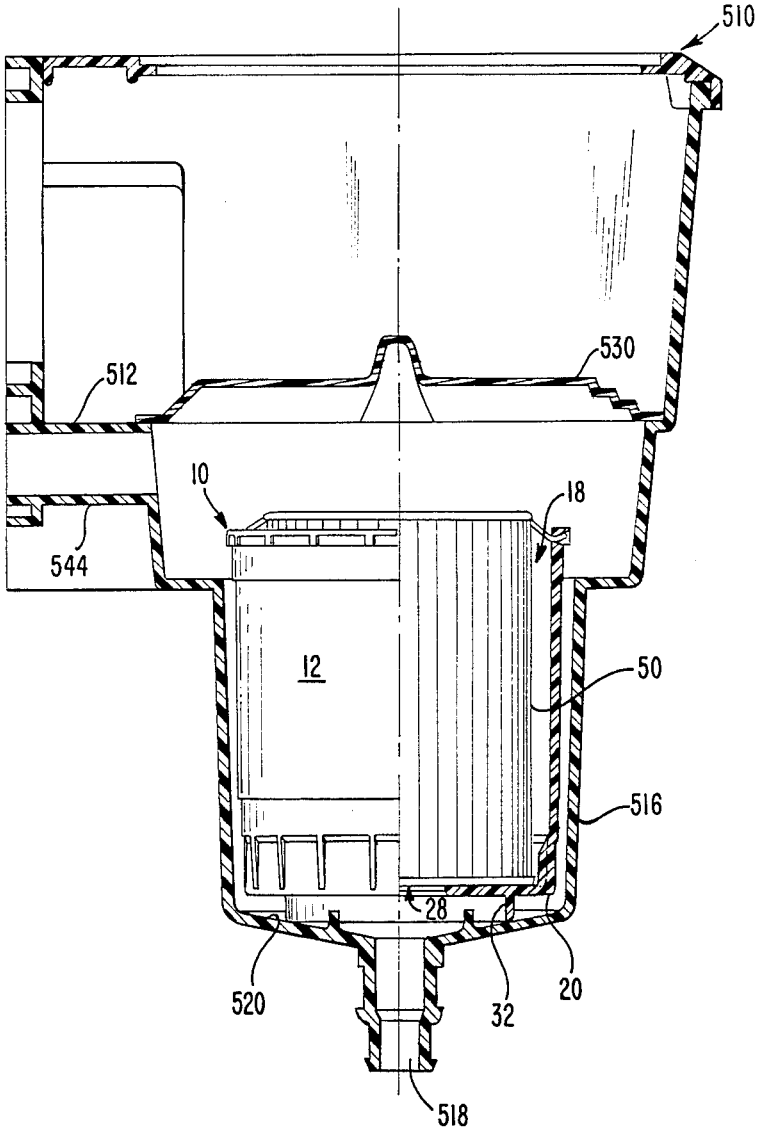
FIG. 8 is a partial cross-sectional view of a still further type of swimming pool skimmer assembly which is equipped with the filter illustrated in FIG. 1 and which is set up to perform a pool vacuuming operation.

Referring finally to FIG. 8, a skimmer assembly 510 is shown in which a lid 530 is mounted in a manner similar to the lids 330, 430 of the skimmer assemblies 310, 410, respectively. Moreover, like the skimmer assemblies 310, 410, the skimmer assembly 510 has a skimmer well 516 in which the filter 10 is seated. However, in contrast to the skimmer assemblies 310, 410, the skimmer well 516 of the skimmer assembly 510 is provided with a sloping floor 520 which engages the flange 32 on the lower end 20 of the housing 12. Another difference between the skimmer assembly 510 and the skimmer assemblies 310, 410 is that the skimmer assembly 510 has a throat 512 which is provided with an integral fitting 544 adapted to receive a vacuum hose (not shown). Thus, the vacuum hose is connected directly to the throat 512 of the skimmer assembly 510, rather than to the lid 530.

It will be understood that the embodiment described herein is merely exemplary and that a person skilled in the art may make many variations and modifications without departing from the spirit and scope of the invention. All such variations and modifications are intended to be included within the scope of the invention as defined in the appended claims.

I claim:

1. Apparatus useful in connection with the performance of a swimming pool vacuuming operation, said apparatus comprising, in combination, a skimmer assembly, said skimmer assembly including a skimmer well having first mounting means for mounting a strainer basket in said skimmer well during the performance of a swimming pool skimming operation and an outlet which communicates with a primary filter; a vacuuming assembly, said vacuuming assembly including a lid mounted across said skimmer well and a vacuum hose attached to said lid; a secondary filter removably mounted in said skimmer well in place of the strainer basket such that said secondary filter is interchangeable with the strainer basket, said secondary filter including a housing mounted directly below said lid by said first mounting means, said housing having an inlet end which is substantially open and an outlet end which is substantially closed, filtering means for filtering fine and coarse debris from water flowing through said filtering means, and positioning means for removably positioning said filtering means inside said housing such that fine and coarse debris are removed from water vacuumed from the swimming pool as the water passes through said filtering means while flowing from said inlet end of said housing to said outlet end of said housing, wherein said apparatus permits said secondary filter to perform a prefiltering function during a swimming pool vacuuming operation and permits the strainer basket to be used in place of said secondary filter to perform a straining function during a swimming pool skimming operation.

2. Apparatus according to claim 1, wherein said skimmer well is retrofitted with said secondary filter.

3. Apparatus according to claim 1, wherein said skimmer well includes second mounting means for removably mounting said lid across said skimmer well.

4. Apparatus according to claim 3, wherein said skimmer well includes a circular ledge located adjacent to an upper end of said skimmer well and an annular support plate extending into said skimmer well from said circular ledge, said annular support plate having an upper surface and an inner circumferential edge.

5. Apparatus according to claim 3, wherein said skimmer well includes a first circular ledge located adjacent to an upper end of said skimmer well and a second circular ledge located adjacent to a lower end of said skimmer well.

6. Apparatus according to claim 3, wherein said skimmer well includes a circular ledge located adjacent to an upper end of said skimmer well and a circular flange extending upwardly from a lower end of said skimmer well.

7. Apparatus according to claim 3, wherein said skimmer well includes a circular ledge located adjacent to an upper end of said skimmer well and a lower end.

8. Apparatus according to claim 4, wherein said second mounting means includes said upper surface of said annular support plate and said first mounting means includes said inner circumferential edge of said support plate, said circumferential edge of said support plate engaging a circular rim extending around and outwardly from said inlet end of said housing of said secondary filter, whereby said secondary filter is suspended into said skimmer well from said support plate.

9. Apparatus according to claim 5, wherein said second mounting means includes said first circular ledge and said first mounting means includes said second circular ledge, said second circular ledge engaging a radially outer portion of said outlet end of said housing of said secondary filter, whereby said secondary filter is seated in said skimmer well.

10. Apparatus according to claim 6, wherein said second mounting means includes said circular ledge and said first mounting means includes said circular flange, said circular flange engaging a radially inner portion of said outlet end of said housing of said secondary filter, whereby said secondary filter is seated in said skimmer well.

11. Apparatus according to claim 7, wherein said second mounting means includes said circular ledge and said first mounting means includes said lower end of said skimmer well, said lower end engaging a circular flange depending from said outlet end of said housing of said secondary filter, whereby said secondary filter is seated in said skimmer well.

12. Apparatus according to claim 1, wherein said filtering means includes a filter cartridge having a first end cap, a second end cap with an opening therein, a porous cylindrical core extending between said first and second end caps and communicating with said opening, and an annular filter element extending between said first and second end caps and surrounding said core.

13. Apparatus according to claim 12, wherein said filter element is made from pleated fabric.

14. Apparatus according to claim 13, wherein said outlet end of said housing includes an outlet and a boss extending around said outlet and into said housing from said outlet end thereof, said boss being removably received within said opening of said second end cap.

15. Apparatus according to claim, 14, further comprising a handle attached to said inlet end of said housing, said handle facilitating the insertion of said secondary filter into said skimmer well and the removal of said secondary filter from said skimmer well.

* * * * *